US009503829B2

(12) United States Patent
Baskaran et al.

(10) Patent No.: US 9,503,829 B2
(45) Date of Patent: Nov. 22, 2016

(54) EAR PRESSURE SENSORS INTEGRATED WITH SPEAKERS FOR SMART SOUND LEVEL EXPOSURE

(71) Applicant: Intel Corporation, Santa Clara, CA (US)

(72) Inventors: Rajashree Baskaran, Seattle, WA (US); Ramon C. Cancel Olmo, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 10 days.

(21) Appl. No.: 14/318,563

(22) Filed: Jun. 27, 2014

(65) Prior Publication Data

US 2015/0382120 A1 Dec. 31, 2015

(51) Int. Cl.
*H04R 29/00* (2006.01)
*H04R 1/10* (2006.01)

(52) U.S. Cl.
CPC ..... *H04R 29/001* (2013.01); *H04R 1/10* (2013.01)

(58) Field of Classification Search
CPC ..... H04R 29/001
USPC ..... 381/56, 58, 72, 74, 315; 702/191; 700/94
See application file for complete search history.

(56) References Cited

U.S. PATENT DOCUMENTS 7,817,803 B2 * 10/2010 Goldstein ..... A61B 5/0002 381/56
2003/0191609 A1 * 10/2003 Bernardi ..... G01H 3/14 702/191
2005/0254667 A1 * 11/2005 Michael ..... G01H 3/14 381/72
2007/0274531 A1 * 11/2007 Camp ..... H04R 5/04 381/74
2009/0147976 A1 * 6/2009 Abolfathi ..... H04R 25/604 381/315
2010/0046767 A1 2/2010 Bayley et al.
2012/0071997 A1 * 3/2012 Aliakseyeu ..... G08G 1/0965 700/94
2012/0288104 A1 11/2012 Goldstein et al.
2013/0083933 A1 4/2013 Aase
2014/0247948 A1 * 9/2014 Goldstein ..... H04R 1/1016 381/58

FOREIGN PATENT DOCUMENTS

JP 2010-239508 A 10/2010

OTHER PUBLICATIONS

International Search Report and Written Opinion for PCT Application No. PCT/US2015/036022, mailed Oct. 16, 2015, 11 pages.
Office Action and Search Report for Taiwanese Patent Application No. 104116069, mailed Jul. 12, 2016, 11 pages including 6 pages of English translation.

* cited by examiner

*Primary Examiner* — Md S Elahee
(74) *Attorney, Agent, or Firm* — Jordan IP Law, LLC

(57) ABSTRACT

Systems and methods may provide for a headset including a housing and a speaker positioned within the housing and directed toward a region external to the housing such as, for example, an ear canal when the headset is being worn. The headset may also include an ear pressure sensor positioned within the housing and directed toward the same region external to the housing. In one example, a measurement signal is received from the pressure sensor, one or more characteristics of an audio signal are automatically adjusted based on the measurement signal, and the audio signal is transmitted to the speaker.

16 Claims, 3 Drawing Sheets

FIG. 3
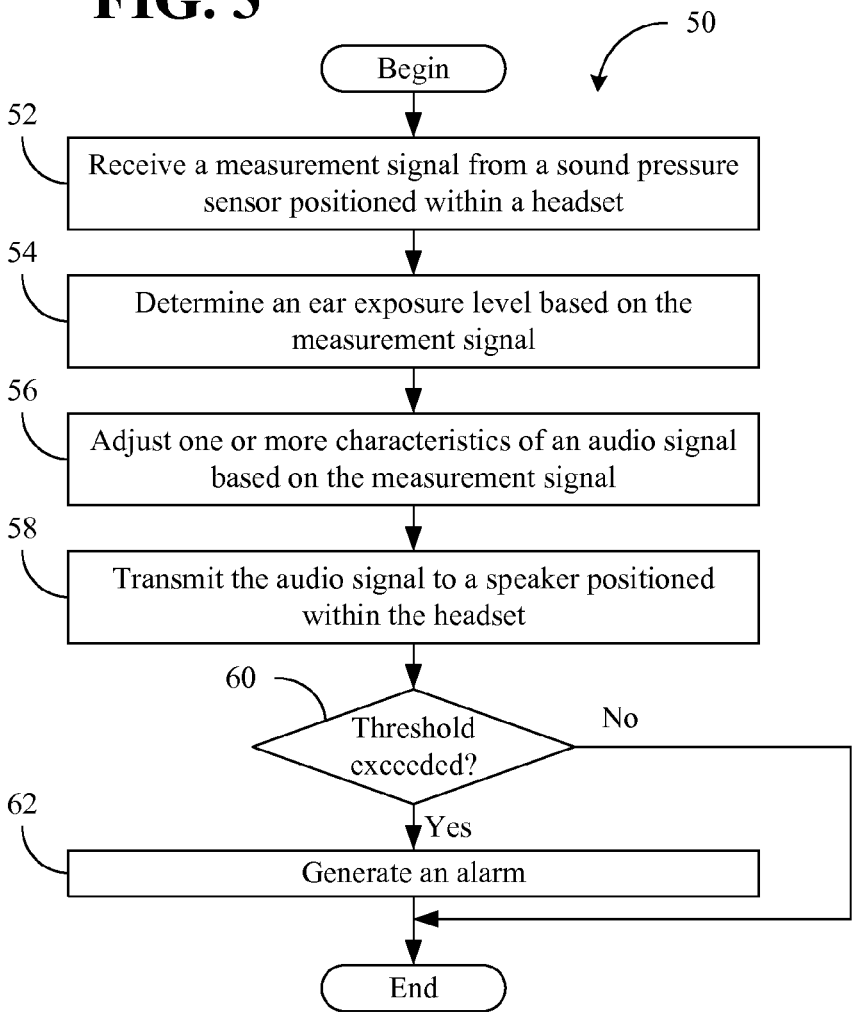
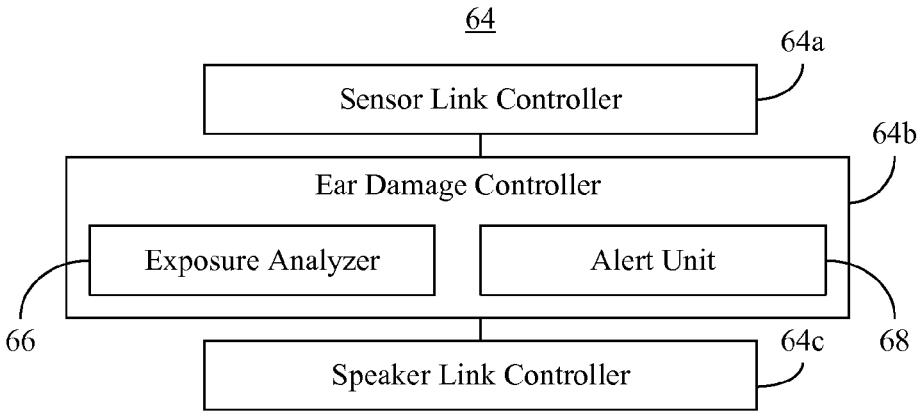
FIG. 4

EAR PRESSURE SENSORS INTEGRATED WITH SPEAKERS FOR SMART SOUND LEVEL EXPOSURE

TECHNICAL FIELD

Embodiments generally relate to audio headsets. More particularly, embodiments relate to the integration of sound pressure sensors with headset speakers to control ear exposure to sound.

BACKGROUND

Audio headsets may deliver sound to the eardrums of the wearer via speakers installed within the headset. Delivery of the sound may generally occur in an open loop fashion that can lead to hearing damage, which may be a function of volume or intensity of sound pressure level (SPL) over time.

BRIEF DESCRIPTION OF THE DRAWINGS

The various advantages of the embodiments will become apparent to one skilled in the art by reading the following specification and appended claims, and by referencing the following drawings, in which:

FIG. 3 is a flowchart of an example of a method of interacting with a headset according to an embodiment;

FIG. 4 is a block diagram of an example of a closed loop logic architecture according to an embodiment.

DESCRIPTION OF EMBODIMENTS

Figure 1:
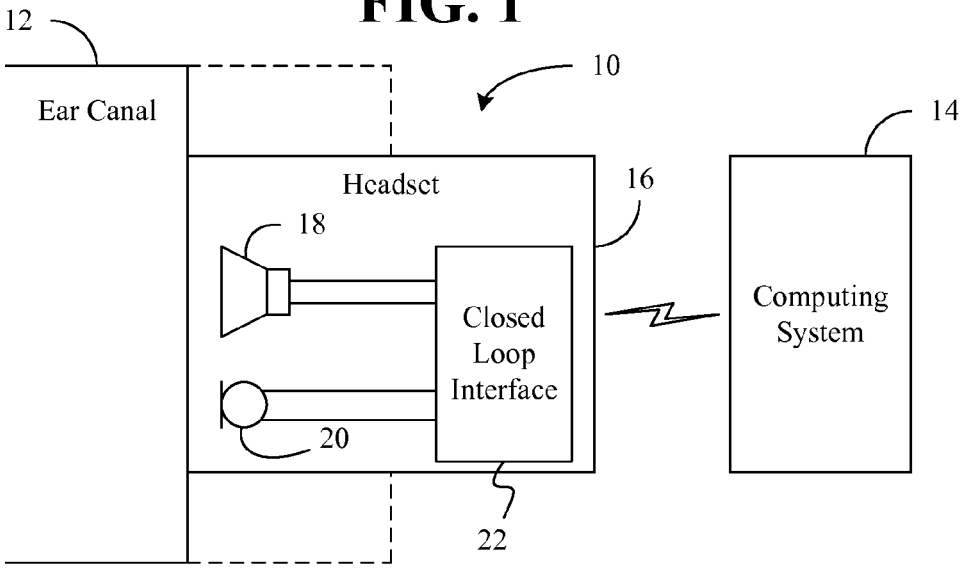
FIG. 1 is a block diagram of an example of a headset according to an embodiment.

Turning now to FIG. 1, a headset 10 is shown, wherein the headset 10 is positioned either within or adjacent to the ear canal 12 of a wearer of the headset 10. The headset 10 may generally be used to deliver sound such as, for example, voice content (e.g., phone call audio), media content (e.g., music, audio corresponding to video content, audio books, etc.), active noise cancellation content, and so forth. The illustrated headset 10 obtains the underlying audio content from a computing system 14 such as, for example, a desktop computer, notebook computer, tablet computer, convertible tablet, personal digital assistant (PDA), mobile Internet device (MID), media player, smart phone, smart televisions (TVs), radios, etc., or any combination thereof. The headset 10 may communicate with the computing system in a wireless and/or wired fashion. Additionally, the headset 10 may deliver the sound to a single ear canal 12 or two ear canals (e.g., left-right channels), depending on the circumstances.

In the illustrated example, the headset 10 includes a housing 16, a speaker 18 that is positioned within the housing 16 and directed toward the ear canal 12, and an ear pressure sensor 20 (e.g., microelectromechanical/MEMS based microphone) that is positioned within the housing 16 and directed toward the ear canal 12. Of particular note is that both the speaker 18 and the sound pressure sensor 20 are directed to the same region external to the housing 16. Additionally, the ear pressure sensor 20 may have a frequency range that is greater than or equal to the frequency range of the speaker 18. As a result, the illustrated sound pressure sensor 20 is able to generate measurement signals that indicate the volume or intensity of sound pressure level (SPL) experienced by the ear canal 12 and/or ear drum (not shown) within the ear canal 12.

A closed loop interface 22 may be coupled to the speaker 28 and the ear pressure sensor 20, wherein the closed loop interface 22 may transmit the measurement signals from the ear pressure sensor 20 to the computing system 14 as well as receive audio signals from the computing system 14. The closed loop interface 22 may include one or more communication modules to conduct wired and/or wireless transfers of the measurement and audio signals. As will be discussed in greater detail, the audio signals from the computing system 14 may be automatically configured to prevent hearing damage to the wearer of the headset 10. In fact, the headset 10 may even be used in place of a conventional hearing aid if equipped with an additional microphone (not shown) to capture ambient noise. Additionally, one or more aspects, modules and/or components of the computing system 14 may be incorporated into the headset 10 (e.g., in a fully integrated system).

Figure 2A:
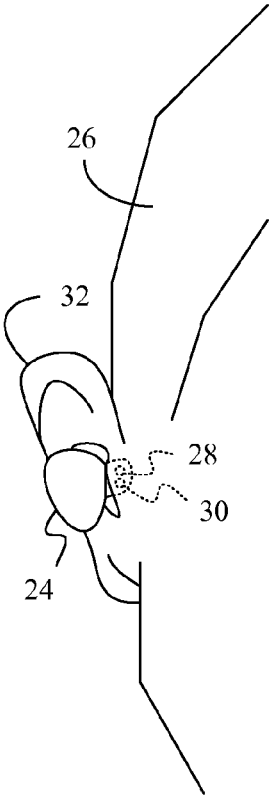
FIGS. 2A-2C are illustrations of examples of headset geometries according to embodiments.
Figure 2B:
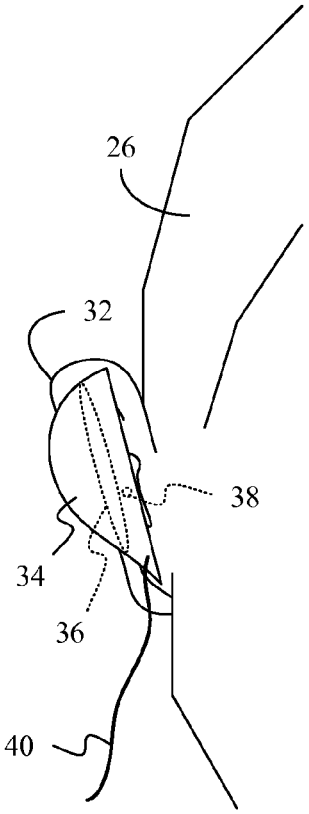
Figure 2C:
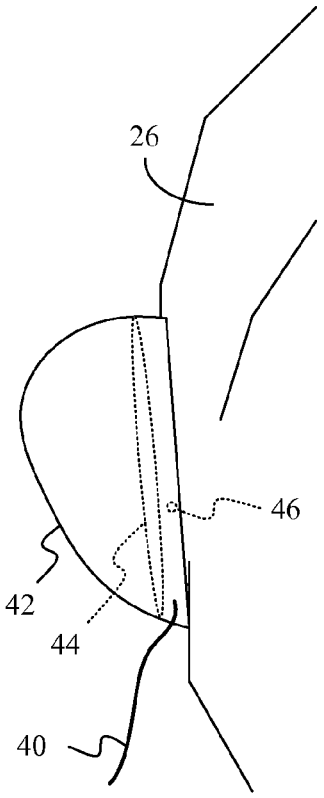

FIGS. 2A-2C demonstrate that the headset may generally have a variety of different geometries. For example, FIG. 2A shows a headset 24 having a housing with an "in ear" geometry in which at least a portion of the headset 24 is inserted within the ear 32 of an individual 26 wearing the headset 24. Thus, both a speaker 28 and an ear pressure sensor 30 of the headset 24 may be directed to the same region external to the housing of the headset 24 (e.g., the ear canal/drum) while the individual 26 wears the headset 24. The headset 24 may also include a closed loop interface (not shown) that uses wireless technology such as, for example, Bluetooth (e.g., Institute of Electrical and Electronics Engineers/IEEE 802.15.1-2005, Wireless Personal Area Networks) technology to transmit measurement signals from the ear pressure sensor 30 to remote devices and receive audio signals from remote devices for the speaker 28. The headset 24 may also include a microphone (not shown) positioned to capture sound/speech from the ambient environment and/or mouth (not shown) of the individual 26 (e.g., if the additional microphone is not directed toward to the ear canal).

FIG. 2B shows a headset 34 having a housing with an "on ear" geometry in which the headset 34 rests on top of the ear 32 of the individual 26 wearing the headset 34. In the illustrated example, a slightly larger speaker 36 (e.g., having a greater dynamic response and/or sound quality) and an ear pressure sensor 38 are directed to the same region external to the housing of the headset 34 while the individual 26 wears the headset 34. The headset 34 may include a wire 40 that carries measurement signals from the ear pressure sensor 38 to remote devices and audio signals from remote devices to the speaker 36. The wire 40 may also include a microphone (not shown) positioned to capture sound/speech from the ambient environment and/or mouth (not shown) of the individual 26.

FIG. 2C shows a headset 42 having a housing with an "over ear" geometry in which the headset 42 covers the ear of the individual 26 in its entirety. In the illustrated example, a relatively large speaker 44 (e.g., having an even greater dynamic response and/or sound quality) and an ear pressure sensor 46 are directed to the same region external to the housing of the headset 42 while the individual 26 wears the headset 42. The headset 42 may also use a wire 40 to carry the measurement signals from the ear pressure sensor 46 to remote devices and audio signals from remote devices to the speaker 36. The pressure level determinations for the examples shown in FIGS. 2A-2C may also take into consideration ear modeling and/or user profile information for the individual 26 to account for any air gaps that might exist between the ear pressure sensors 30, 38, 46 and the ear canal of the individual 26. In addition, the ability of the individual 26 to hear specific frequencies may be stored in the user profile information and used to adjust the characteristics of the audio signal (e.g., audiology test results incorporated into the user profile information). Indeed, the computing system may generate tones at particular frequencies and amplitudes in order to conduct the audiology test via the headsets 24, 34, 42. The headsets 24, 34, 42 may also include appropriate structures (not shown) to physically secure the headsets 24, 34, 42 to the ear 32 and/or head of the individual 26.

Turning now to FIG. 3, a method 50 of interacting with a headset is shown. The method 50 may be implemented in a computing system such as, for example, the computing system 14 (FIG. 1), already discussed. More particularly, the method 50 may be implemented as one or more modules in a set of logic instructions stored in a machine- or computer-readable storage medium such as random access memory (RAM), read only memory (ROM), programmable ROM (PROM), firmware, flash memory, etc., in configurable logic such as, for example, programmable logic arrays (PLAs), field programmable gate arrays (FPGAs), complex programmable logic devices (CPLDs), in fixed-functionality hardware logic using circuit technology such as, for example, application specific integrated circuit (ASIC), complementary metal oxide semiconductor (CMOS) or transistor-transistor logic (TTL) technology, or any combination thereof.

Illustrated processing block 52 provides for receiving a measurement signal from a sound pressure sensor positioned within in a headset. Block 52 may also involve receiving contextual data from one or more additional sensors such as, for example, temperature sensors, ambient light sensors, accelerometers, and so forth. An ear exposure level may be determined at block 54 based on the measurement signal and/or the contextual data. The ear exposure level may be determined as a cumulative value (e.g., over a fixed or variable amount of time such as minutes, hours, days, weeks, etc.), an instantaneous value, etc., or any combination thereof. Moreover, the ear exposure level may be determined for a plurality of frequencies such as, for example, the dynamic range of frequencies produced by a speaker positioned within the headset. In this regard, the sound pressure sensor may have a frequency range that is greater than or equal to the frequency range of the speaker.

Block 56 may automatically adjust one or more characteristics of an audio signal based on the measurement signal and/or the contextual data, wherein the characteristics may include, for example, a volume or frequency profile of the audio signal. The audio signal may include voice content, media content, active noise cancellation content, and so forth. Thus, adjusting the audio signal might involve, for example, reducing the volume of certain high frequencies in media content if the measurement signal indicates that the eardrums of the wearer of the headset have been exposed to high volumes of sound at those frequencies for a relatively long period of time (e.g., the wearer listening to rock music). Indeed, more aggressive (e.g., louder) volume settings might be automatically chosen earlier in the listening experience, with volume reductions being automatically made over time as the cumulative ear exposure level grows. In another example, adjusting the audio signal might involve changing the frequency profile of active noise cancellation content delivered to the headset so that it more effectively cancels out ambient noise (e.g., the wearer is working in a noisy industrial environment). Additionally, the adjustment may be channel specific (e.g., left-right channel).

With specific regard to the contextual data, information such as temperature data, ambient light levels, motion data, and so forth, may used to draw inferences about the usage conditions and/or ambient environment (e.g., outdoors versus indoors) and further tailor the audio signal adjustments to those inferences. Thus, if relatively high ambient temperatures are detected, for example, lower volumes might be selected to extend the life of the headset speakers. Illustrated block 58 transmits the adjusted audio signal to a speaker positioned within the headset.

A determination may also be made at block 60 as to whether the ear exposure level has exceeded a threshold. The threshold may be, for example, a cumulative (e.g., hourly, daily, weekly, etc.) or instantaneous threshold. If the ear exposure level exceeds the threshold, block 62 may generate an alarm. The alarm may be audible, tactile, visual, etc., and may be output locally on the computing system, via the headset or to another platform (e.g., via text message, email, instant message). Additionally, one or more aspects of the method 50 may be incorporated into the headset itself.

FIG. 4 shows a closed loop logic architecture 64 (64*a*-64*c*) that may be used to prevent hearing damage. The architecture 64 may implement one or more aspects of the method 50 (FIG. 3) and may be readily incorporated into a computing system such as, for example, the computing system 14 (FIG. 1), a headset such as, for example, the headset 10 (FIG. 1), or any combination thereof. In the illustrated example, the architecture 64 includes a sensor link controller 64*a*, which may receive a measurement signal from a sound pressure sensor positioned within a headset. Additionally, an ear damage controller 64*b* may be coupled to the sensor link controller 64*a*. The ear damage controller 64*b* may adjust one or more characteristics of an audio signal based on the measurement signal. As already discussed, at least one of the one or more characteristics may include a volume or a frequency profile of the audio signal, wherein the audio signal includes one or more of voice content, media content or active noise cancellation content. The illustrated architecture 64 also includes a speaker link controller 64*c* coupled to the ear damage controller 64*b*, wherein the speaker link controller 64*c* may transmit the audio signal to a speaker positioned within the headset.

Figure 5:
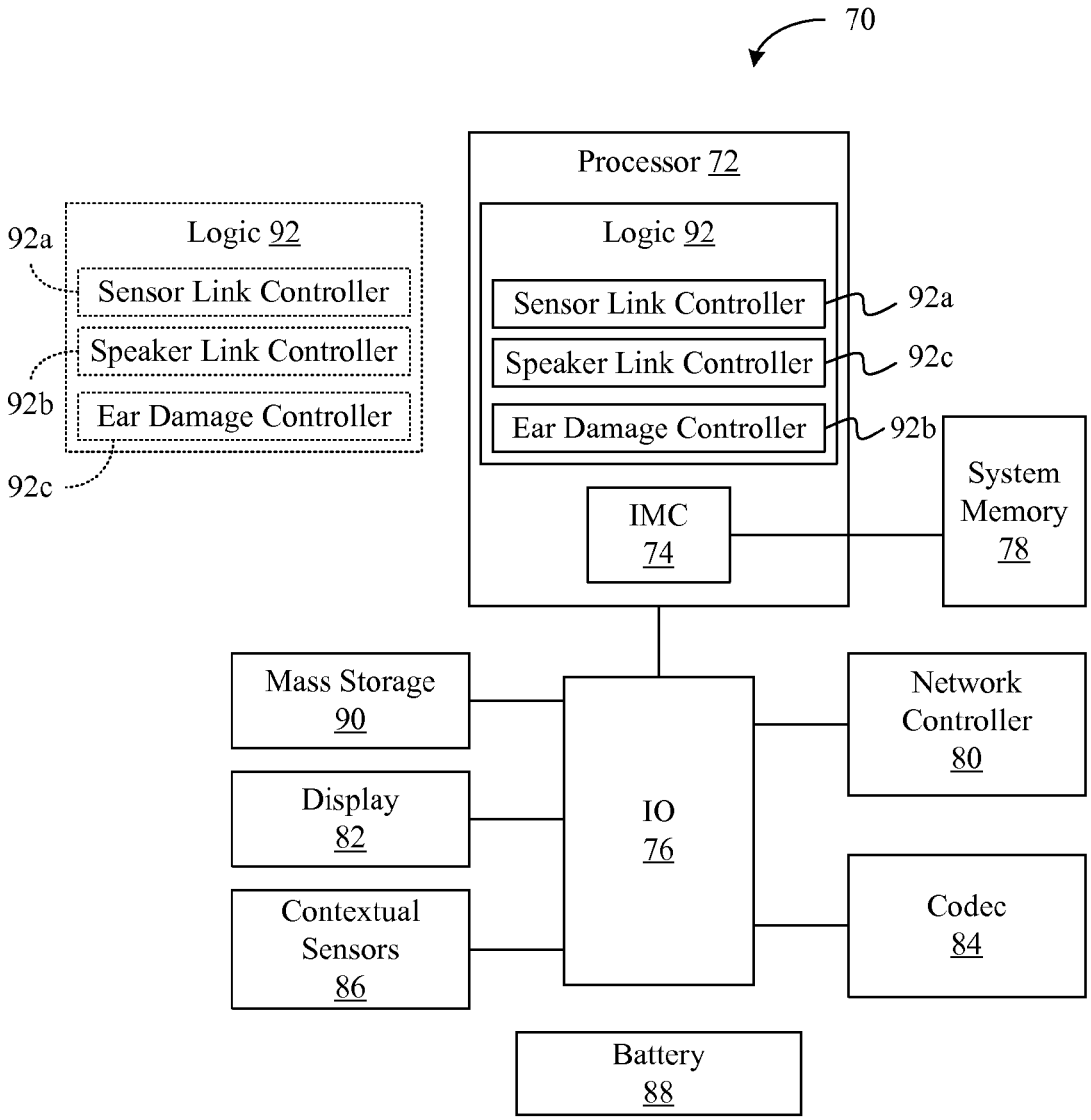
FIG. 5 is a block diagram of an example of a computing system according to an embodiment.

In one example, the ear damage controller 64*b* includes an exposure analyzer 66 to determine an ear exposure level based on the measurement signal, wherein at least one of the one or more characteristics is to be adjusted based on the ear exposure level. As already noted, the ear exposure level may be a cumulative value and/or an instantaneous value. Moreover, the ear exposure level may be determined for a plurality of frequencies. The illustrated ear damage controller 64*b* also includes an alert unit 68 to generate an alert if the ear exposure level exceeds a threshold. FIG. 5 shows a computing system 70 that may be part of a device having computing functionality (e.g., PDA, notebook computer, tablet computer, convertible tablet, desktop computer, cloud server), communications functionality (e.g., wireless smart phone, radio), imaging functionality, media playing functionality (e.g., smart television/TV), wearable computer (e.g., headwear, clothing, jewelry, eyewear, etc.) or any combination thereof (e.g., MID). In the illustrated example, the system 70 includes a processor 72, an integrated memory controller (IMC) 74, an input output (IO) module 76, system memory 78, a network controller 80, a display 82, a codec 84, one or more contextual sensors 86 (e.g., temperature sensors, ambient light sensors, accelerometers), a battery 88 and mass storage 90 (e.g., optical disk, hard disk drive/HDD, flash memory).

The processor 72 may include a core region with one or several processor cores (not shown). The illustrated IO module 76, sometimes referred to as a Southbridge or South Complex of a chipset, functions as a host controller and communicates with the network controller 80, which could provide off-platform communication functionality for a wide variety of purposes such as, for example, cellular telephone (e.g., Wideband Code Division Multiple Access/W-CDMA (Universal Mobile Telecommunications System/UMTS), CDMA2000 (IS-856/IS-2000), etc.), WiFi (Wireless Fidelity, e.g., Institute of Electrical and Electronics Engineers/IEEE 802.11-2007, Wireless Local Area Network/LAN Medium Access Control (MAC) and Physical Layer (PHY) Specifications), 4G LTE (Fourth Generation Long Term Evolution), Bluetooth, WiMax (e.g., IEEE 802.16-2004, LAN/MAN Broadband Wireless LANS), Global Positioning System (GPS), spread spectrum (e.g., 900 MHz), and other radio frequency (RF) telephony purposes. Other standards and/or technologies may also be implemented in the network controller 80.

The network controller 80 may therefore exchange measurement signals and audio signals with a closed loop interface such as, for example, the closed loop interface 22 (FIG. 1). The IO module 76 may also include one or more hardware circuit blocks (e.g., smart amplifiers, analog to digital conversion, integrated sensor hub) to support such wireless and other signal processing functionality.

Although the processor 72 and I0 module 76 are illustrated as separate blocks, the processor 72 and 10 module 76 may be implemented as a system on chip (SoC) on the same semiconductor die. The system memory 78 may include, for example, double data rate (DDR) synchronous dynamic random access memory (SDRAM, e.g., DDR3 SDRAM JEDEC Standard JESD79-3C, April 2008) modules. The modules of the system memory 78 may be incorporated into a single inline memory module (SIMM), dual inline memory module (DIMM), small outline DIMM (SODIMM), and so forth.

The illustrated processor 72 includes logic 92 (92*a*-92*c*, e.g., logic instructions, configurable logic, fixed-functionality hardware logic, etc., or any combination thereof) including a sensor link controller 92*a* to receive measurement signals from a sound pressure sensor positioned within a headset. The illustrated logic 92 also includes an ear damage controller 92*b* coupled to the sensor link controller 92*a*, wherein the ear damage controller 92*b* may adjust one or more characteristics of audio signals based on the measurement signals. Additionally, a speaker link controller 92*c* may be coupled to the ear damage controller 92*b*. The speaker link controller 92*c* may transmit the audio signals to a speaker positioned within the headset. The ear damage controller 92*b* may also adjust the audio signals based on contextual data received from one or more of the contextual sensors 86. Although the illustrated logic 92 is shown as being implemented on the processor 72, one or more aspects of the logic 92 may be implemented elsewhere on the computing system 70 (e.g., in the headset), depending on the circumstances.

Additional Notes and Examples:

Example 1 may include a computing system to control sound level exposure, comprising a sensor link controller to receive a measurement signal from a sound pressure sensor positioned within a headset, an ear damage controller coupled to the sensor link controller, the ear damage controller to adjust one or more characteristics of an audio signal based on the measurement signal, and a speaker controller coupled to the ear damage controller, the speaker link controller to transmit the audio signal to a speaker positioned within the headset.

Example 2 may include the computing system of Example 1, wherein the ear damage controller includes an exposure analyzer to determine an ear exposure level based on the measurement signal, and wherein at least one of the one or more characteristics is to be adjusted based on the ear exposure level.

Example 3 may include the computing system of Example 2, wherein the ear exposure level is to be one of a cumulative value or an instantaneous value.

Example 4 may include the computing system of Example 2, wherein the ear exposure level is to be determined for a plurality of frequencies.

Example 5 may include the computing system of Example 2, wherein the ear damage controller further includes an alert unit to generate an alert if the ear exposure level exceeds a threshold.

Example 6 may include the computing system of any one of Examples 1 to 5, wherein at least one of the one or more characteristics is to include a volume or a frequency profile of the audio signal, and wherein the audio signal is to include one or more of voice content, media content or active noise cancellation content.

Example 7 may include a headset comprising a housing, a speaker positioned within the housing and directed toward a region external to the housing, and an ear pressure sensor positioned within the housing and directed toward the region external to the housing.

Example 8 may include the headset of Example 7, further including a closed loop interface coupled to the speaker and the ear pressure sensor.

Example 9 may include the headset of Example 7, wherein the ear pressure sensor has a frequency range that is greater than or equal to a frequency range of the speaker.

Example 10 may include the headset of any one of Examples 7 to 9, wherein the housing has an in ear geometry.

Example 11 may include the headset of any one of Examples 7 to 9, wherein the housing has an on ear geometry.

Example 12 may include the headset of any one of Examples 7 to 9, wherein the housing has an over ear geometry.

Example 13 may include a method of interacting with a headset, comprising receiving a measurement signal from a sound pressure sensor positioned within the headset, adjusting one or more characteristics of an audio signal based on the measurement signal, and transmitting the audio signal to a speaker positioned within the headset.

Example 14 may include the method of Example 13, further including determining an ear exposure level based on the measurement signal, wherein at least one of the one or more characteristics is adjusted based on the ear exposure level.

Example 15 may include the method of Example 14, wherein the ear exposure level is one of a cumulative value or an instantaneous value.

Example 16 may include the method of Example 14, wherein the ear exposure level is determined for a plurality of frequencies.

Example 17 may include the method of Example 14, further including generating an alert if the ear exposure level exceeds a threshold.

Example 18 may include the method of any one of Examples 13 to 17, wherein at least one of the one or more characteristics includes a volume or a frequency profile of the audio signal, and wherein the audio signal includes one or more of voice content, media content or active noise cancellation content.

Example 19 may include the method of any one of Examples 13 to 17, further including receiving contextual data from one or more additional sensors, wherein at least one of the one or more characteristics is adjusted further based on the contextual data.

Example 20 may include at least one computer readable storage medium comprising a set of instructions which, when executed by a computing system, cause the computing system to receive a measurement signal from a sound pressure sensor positioned within a headset, adjust one or more characteristics of an audio signal based on the measurement signal, and transmit the audio signal to a speaker positioned within the headset.

Example 21 may include the at least one computer readable storage medium of Example 20, wherein the instructions, when executed, cause a computing system to determine an ear exposure level based on the measurement signal, and wherein at least one of the one or more characteristics is to be adjusted based on the ear exposure level.

Example 22 may include the at least one computer readable storage medium of Example 21, wherein the ear exposure level is to be one of a cumulative value or an instantaneous value.

Example 23 may include the at least one computer readable storage medium of Example 21, wherein the ear exposure level is to be determined for a plurality of frequencies.

Example 24 may include the at least one computer readable storage medium of Example 21, wherein the instructions, when executed, cause a computing system to generate an alert if the ear exposure level exceeds a threshold.

Example 25 may include the at least one computer readable storage medium of any one of Examples 20 to 24, wherein at least one of the one or more characteristics is to include a volume or a frequency profile of the audio signal, and wherein the audio signal is to include one or more of voice content, media content or active noise cancellation content.

Example 26 may include a computing system to control sound level exposure, comprising means for performing the method of any of Examples 13 to 19.

Thus, techniques may provide real time monitoring and feedback during musing listening, enabling "louder" listening within safe levels. Volume may be automatically adjusted and alerts may be automatically generated in order to prevent hearing damage. Moreover, context aware volume adjustments may enable volume changes to be made as a mechanism to compensate for environmental noise levels. Thus, the computing system may determine, for example, whether the wearer of the headset is in a quiet room versus a crowded outdoor setting versus driving, etc. Contextual data may also provide for enhanced and smarter active noise cancellation. Additionally, for individuals working in noisy environments on a regular basis, ear exposure to sound intensity may be monitored across a wide range of frequencies. The closed loop techniques may also enable highly accurate ear exposure levels to be made that are not dependent on the efficiency of the speakers or other output power based techniques.

Embodiments are applicable for use with all types of semiconductor integrated circuit ("IC") chips. Examples of these IC chips include but are not limited to processors, controllers, chipset components, programmable logic arrays (PLAs), memory chips, network chips, systems on chip (SoCs), SSD/NAND controller ASICs, and the like. In addition, in some of the drawings, signal conductor lines are represented with lines. Some may be different, to indicate more constituent signal paths, have a number label, to indicate a number of constituent signal paths, and/or have arrows at one or more ends, to indicate primary information flow direction. This, however, should not be construed in a limiting manner. Rather, such added detail may be used in connection with one or more exemplary embodiments to facilitate easier understanding of a circuit. Any represented signal lines, whether or not having additional information, may actually comprise one or more signals that may travel in multiple directions and may be implemented with any suitable type of signal scheme, e.g., digital or analog lines implemented with differential pairs, optical fiber lines, and/or single-ended lines.

Example sizes/models/values/ranges may have been given, although embodiments are not limited to the same. As manufacturing techniques (e.g., photolithography) mature over time, it is expected that devices of smaller size could be manufactured. In addition, well known power/ground connections to IC chips and other components may or may not be shown within the figures, for simplicity of illustration and discussion, and so as not to obscure certain aspects of the embodiments. Further, arrangements may be shown in block diagram form in order to avoid obscuring embodiments, and also in view of the fact that specifics with respect to implementation of such block diagram arrangements are highly dependent upon the platform within which the embodiment is to be implemented, i.e., such specifics should be well within purview of one skilled in the art. Where specific details (e.g., circuits) are set forth in order to describe example embodiments, it should be apparent to one skilled in the art that embodiments can be practiced without, or with variation of, these specific details. The description is thus to be regarded as illustrative instead of limiting.

The term "coupled" may be used herein to refer to any type of relationship, direct or indirect, between the components in question, and may apply to electrical, mechanical, fluid, optical, electromagnetic, electromechanical or other connections. In addition, the terms "first", "second", etc. may be used herein only to facilitate discussion, and carry no particular temporal or chronological significance unless otherwise indicated.

As used in this application and in the claims, a list of items joined by the term "one or more of" may mean any combination of the listed terms. For example, the phrases "one or more of A, B or C" may mean A, B, C; A and B; A and C; B and C; or A, B and C.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

We claim:

1. A computing system comprising:

a sensor link controller to receive a measurement signal from a sound pressure sensor positioned within a headset;

an ear damage controller coupled to the sensor link controller, the ear damage controller to automatically adjust one or more characteristics of an audio signal based on the measurement signal to prevent hearing damage to a wearer of the headset; and a speaker link controller coupled to the ear damage controller, the speaker link controller to transmit the audio signal to a speaker positioned within the headset, wherein the ear damage controller includes an exposure analyzer to determine an ear exposure level based on the measurement signal, and wherein at least one of the one or more characteristics is to be adjusted based on the ear exposure level.

2. The computing system of claim 1, wherein the ear exposure level is to be one of a cumulative value or an instantaneous value.

3. The computing system of claim 1, wherein the ear exposure level is to be determined for a plurality of frequencies.

4. The computing system of claim 1, wherein the ear damage controller further includes an alert unit to generate an alert if the ear exposure level exceeds a threshold.

5. The computing system of claim 1, wherein at least one of the one or more characteristics is to include a volume or a frequency profile of the audio signal, and wherein the audio signal is to include one or more of voice content, media content or active noise cancellation content.

6. A method of interacting with a headset, comprising:

receiving, via a senor link controller, a measurement signal from a sound pressure sensor positioned within the headset;

automatically adjusting, via an ear damage controller having an exposure analyzer, one or more characteristics of an audio signal based on the measurement signal to prevent hearing damage to a wear of the headset;

determining, via the exposure analyzer, an ear exposure level based on the measurement signal, wherein at least one of the one or more characteristics is adjusted based on the ear exposure level; and transmitting, via a speaker link controller, the audio signal to a speaker positioned within the headset.

7. The method of claim 6, wherein the ear exposure level is one of a cumulative value or an instantaneous value.

8. The method of claim 6, wherein the ear exposure level is determined for a plurality of frequencies.

9. The method of claim 6, further including generating an alert if the ear exposure level exceeds a threshold.

10. The method of claim 6, wherein at least one of the one or more characteristics includes a volume or a frequency profile of the audio signal, and wherein the audio signal includes one or more of voice content, media content or active noise cancellation content.

11. The method of claim 6, further including receiving contextual data from one or more additional sensors, wherein at least one of the one or more characteristics is adjusted further based on the contextual data.

12. At least one non-transitory computer readable storage medium comprising a set of instructions which, when executed by a computing system, cause the computing system to:

receive a measurement signal from a sound pressure sensor positioned within a headset;

automatically adjust one or more characteristics of an audio signal based on the measurement signal to prevent hearing damage to wearer of the headset;

determine an ear exposure level based on the measurement signal, wherein at least one of the one or more characteristics is to be adjusted based on the ear exposure level; and transmit the audio signal to a speaker positioned within the headset.

13. The at least one computer readable storage medium of claim 12, wherein the ear exposure level is to be one of a cumulative value or an instantaneous value.

14. The at least one non-transitory computer readable storage medium of claim 12, wherein the ear exposure level is to be determined for a plurality of frequencies.

15. The at least one non-transitory computer readable storage medium of claim 12, wherein the instructions, when executed, cause a computing system to generate an alert if the ear exposure level exceeds a threshold.

16. The at least one non-transitory computer readable storage medium of claim 12, wherein at least one of the one or more characteristics is to include a volume or a frequency profile of the audio signal, and wherein the audio signal is to include one or more of voice content, media content or active noise cancellation content.

* * * * *